US008904686B2

(12) United States Patent
Greer

(10) Patent No.: US 8,904,686 B2
(45) Date of Patent: Dec. 9, 2014

(54) CONTINUOUS STRIP OF THERMAL WRISTBAND/LABEL FORMS

(75) Inventor: Mark Greer, O'Fallon, MO (US)

(73) Assignee: Laser Band, LLC, St. Louis, MO (US)

( * ) Notice: Subject to any disclaimer, the term of this patent is extended or adjusted under 35 U.S.C. 154(b) by 1351 days.

(21) Appl. No.: 12/026,030

(22) Filed: Feb. 5, 2008

(65) Prior Publication Data

US 2009/0193701 A1 Aug. 6, 2009

(51) Int. Cl.
*G09F 3/02* (2006.01)
*G09F 3/00* (2006.01)

(52) U.S. Cl.
CPC ..... *G09F 3/005* (2013.01); *G09F 3/0288* (2013.01); *G09F 2003/0222* (2013.01); *G09F 2003/0227* (2013.01); *G09F 2003/0267* (2013.01); *G09F 2003/0201* (2013.01)
USPC ..... 40/633

(58) Field of Classification Search
USPC ..... 40/633; 428/43
See application file for complete search history.

(56) References Cited

U.S. PATENT DOCUMENTS

| | | | | |
|---|---|---|---|---|
| 230,455 | A | 7/1880 | Wilcox | |
| 919,983 | A | 4/1909 | Walsh | |
| 922,948 | A | 5/1909 | Portmore | |
| 1,383,335 | A | 7/1921 | Penksa | |
| 1,517,456 | A | 12/1924 | Pulliam | |
| 2,054,227 | A | 9/1936 | Nichols | |
| 2,073,280 | A | 3/1937 | Lederer | |
| 2,553,676 | A | 5/1951 | Roos | |
| 2,641,074 | A | 6/1953 | Richmond | |
| 2,687,978 | A * | 8/1954 | Vogt | 428/43 |
| 3,153,869 | A | 10/1964 | Twentier | |
| 3,197,899 | A | 8/1965 | Twentie | |
| 3,402,808 | A | 9/1968 | Yannuzzi | |
| 3,517,802 | A | 6/1970 | Petrie | |
| 3,585,743 | A | 6/1971 | Jeffers | |

(Continued)

FOREIGN PATENT DOCUMENTS

| | | |
|---|---|---|
| DE | 202009015077 U1 | 1/2010 |
| EP | 1039431 | 9/2000 |

(Continued)

OTHER PUBLICATIONS

ID Warehouse (http://web.archive.org/web/20050131235601/http://idwarehouse.com/) Jan. 31, 2005. p. 1: WB1908, Stock Vinyl Wristband.

(Continued)

*Primary Examiner* — Charles A Fox
*Assistant Examiner* — Christopher e Veraa
(74) *Attorney, Agent, or Firm* — Alston & Bird LLP

(57) ABSTRACT

A thermal printer processible combination wristband/label form has a top portion comprising a wristband which occupies substantially the entirety of thereof and a bottom portion comprising one of several alternative embodiments of labels. The label embodiments include a plurality of individually formed labels, a plurality of labels occupying substantially the entirety of the bottom portion, and a die cut defining a label portion with pairs of nicks spaced along an upper and lower border of the die cut and between which a user may tear off labels of a desired length including different lengths. The form is produced in quantity and joined together into a fan fold strip having an overall width of a nominal two inches so as to be capable of being printed by relatively older thermal printers having a nominal two inch throat.

18 Claims, 3 Drawing Sheets

(56) References Cited

U.S. PATENT DOCUMENTS

| | | | |
|---|---|---|---|
| 3,660,916 | A | 5/1972 | McDermott et al. |
| 3,854,229 | A | 12/1974 | Morgan |
| 4,004,362 | A | 1/1977 | Barbieri |
| 4,078,324 | A | 3/1978 | Wiebe |
| 4,179,833 | A | 12/1979 | Knodel |
| 4,226,036 | A | 10/1980 | Krug |
| 4,233,715 | A | 11/1980 | McDermott |
| 4,370,370 | A | 1/1983 | Iwata et al. |
| 4,565,731 | A | 1/1986 | Komatsu et al. |
| 4,612,718 | A | 9/1986 | Golub et al. |
| 4,627,994 | A | 12/1986 | Welsch |
| 4,630,384 | A | 12/1986 | Breen |
| 4,682,431 | A | 7/1987 | Kowalchuk et al. |
| 4,696,843 | A | 9/1987 | Schmidt |
| 4,783,917 | A | 11/1988 | Smith et al. |
| 4,829,604 | A | 5/1989 | Allen et al. |
| 4,854,610 | A | 8/1989 | Kwiatek |
| 4,855,277 | A | 8/1989 | Walter |
| 4,914,843 | A | 4/1990 | DeWoskin |
| 4,941,210 | A | 7/1990 | Konucik |
| 4,950,638 | A | 8/1990 | Yuyama et al. |
| 4,956,931 | A | 9/1990 | Selke |
| 4,978,144 | A | 12/1990 | Schmidt et al. |
| 4,991,337 | A | 2/1991 | Solon |
| RE33,616 | E | 6/1991 | Welsch |
| 5,026,084 | A | 6/1991 | Pasfield |
| 5,045,426 | A | 9/1991 | Maierson et al. |
| 5,135,789 | A | 8/1992 | Schmidt |
| 5,222,823 | A | 6/1993 | Conforti |
| 5,227,004 | A | 7/1993 | Belger |
| 5,227,209 | A | 7/1993 | Garland |
| 5,283,969 | A | 2/1994 | Weiss |
| 5,311,689 | A | 5/1994 | Lindsey |
| 5,318,326 | A | 6/1994 | Garrison |
| 5,331,140 | A | 7/1994 | Stephany |
| 5,351,993 | A | 10/1994 | Wright et al. |
| 5,370,420 | A | 12/1994 | Khatib et al. |
| 5,381,617 | A | 1/1995 | Schwartztol et al. |
| 5,383,686 | A | 1/1995 | Laurash |
| 5,395,667 | A | 3/1995 | Ohno et al. |
| 5,418,026 | A | 5/1995 | Dronzek, Jr. et al. |
| 5,427,416 | A | 6/1995 | Birch et al. |
| 5,486,021 | A | 1/1996 | Laurash |
| 5,486,436 | A | 1/1996 | Lakes |
| 5,509,693 | A | 4/1996 | Kohls |
| 5,509,694 | A | 4/1996 | Laurash et al. |
| 5,518,787 | A | 5/1996 | Konkol |
| 5,524,934 | A | 6/1996 | Schwan et al. |
| 5,547,227 | A | 8/1996 | Laurash et al. |
| 5,560,657 | A | 10/1996 | Morgan |
| 5,581,924 | A | 12/1996 | Peterson |
| 5,586,788 | A | 12/1996 | Laurash |
| 5,595,404 | A | 1/1997 | Skees |
| 5,596,202 | A | 1/1997 | Arakawa |
| 5,598,970 | A | 2/1997 | Mudry et al. |
| 5,601,222 | A | 2/1997 | Haddad |
| 5,601,313 | A | 2/1997 | Konkol et al. |
| 5,630,627 | A | 5/1997 | Stewart |
| 5,637,369 | A | 6/1997 | Stewart |
| 5,648,143 | A | 7/1997 | Mehta et al. |
| 5,653,472 | A | 8/1997 | Huddleston et al. |
| 5,662,976 | A | 9/1997 | Popat et al. |
| 5,670,015 | A | 9/1997 | Finestone et al. |
| 5,687,903 | A | 11/1997 | Akridge et al. |
| 5,765,885 | A | 6/1998 | Netto et al. |
| 5,785,354 | A | 7/1998 | Haas |
| 5,842,722 | A | 12/1998 | Carlson |
| 5,877,742 | A | 3/1999 | Klink |
| 5,933,993 | A | 8/1999 | Riley |
| 5,984,363 | A | 11/1999 | Dotson et al. |
| 6,000,160 | A | 12/1999 | Riley |
| 6,006,460 | A | 12/1999 | Blackmer |
| 6,016,618 | A | 1/2000 | Attia et al. |
| 6,053,535 | A | 4/2000 | Washburn et al. |
| 6,055,756 | A | 5/2000 | Aoki |
| 6,058,639 | A | 5/2000 | Tinklenberg et al. |
| 6,067,739 | A | 5/2000 | Riley |
| 6,071,585 | A | 6/2000 | Roth |
| 6,092,321 | A | 7/2000 | Cheng et al. |
| 6,108,876 | A | 8/2000 | Hubbert |
| 6,155,476 | A | 12/2000 | Fabel |
| 6,155,603 | A | 12/2000 | Fox |
| 6,159,570 | A | 12/2000 | Ulrich et al. |
| 6,199,730 | B1 | 3/2001 | Chisolm |
| 6,303,539 | B1 | 10/2001 | Kosarew |
| 6,331,018 | B1 | 12/2001 | Roth et al. |
| 6,343,819 | B1 | 2/2002 | Shiozaki |
| 6,361,078 | B1 | 3/2002 | Chess |
| 6,409,871 | B1 | 6/2002 | Washburn et al. |
| 6,438,881 | B1 | 8/2002 | Riley |
| 6,510,634 | B1 | 1/2003 | Riley |
| 6,517,921 | B2 | 2/2003 | Ulrich et al. |
| 6,611,962 | B2 | 9/2003 | Redwood et al. |
| 6,641,048 | B1 | 11/2003 | Schintz et al. |
| 6,685,228 | B2 | 2/2004 | Riley |
| 6,748,687 | B2 | 6/2004 | Riley |
| 6,782,648 | B1 * | 8/2004 | Mosher, Jr. ..... 40/633 |
| 6,807,680 | B2 | 10/2004 | Sloot |
| 6,836,215 | B1 | 12/2004 | Laurash et al. |
| 6,844,041 | B2 | 1/2005 | Squier et al. |
| 6,863,311 | B2 | 3/2005 | Riley |
| 6,981,948 | B2 | 1/2006 | Pellegrino et al. |
| 7,017,293 | B2 | 3/2006 | Riley |
| 7,017,294 | B2 | 3/2006 | Riley |
| 7,047,682 | B2 | 5/2006 | Riley |
| 7,197,842 | B2 | 4/2007 | Ali |
| 7,222,448 | B2 | 5/2007 | Riley |
| 7,240,446 | B2 | 7/2007 | Bekker |
| 7,286,055 | B2 | 10/2007 | Girvin et al. |
| 7,523,576 | B1 | 4/2009 | Petty |
| 7,763,344 | B2 | 7/2010 | Riley et al. |
| 7,779,569 | B2 | 8/2010 | Riley et al. |
| 7,779,570 | B2 | 8/2010 | Riley |
| 7,784,209 | B2 | 8/2010 | Greer |
| 7,784,210 | B2 | 8/2010 | Riley et al. |
| 7,818,908 | B2 | 10/2010 | Greer |
| 7,823,310 | B2 | 11/2010 | Jain et al. |
| 2002/0152928 | A1 | 10/2002 | Lawandy et al. |
| 2002/0176973 | A1 | 11/2002 | Keiser |
| 2003/0001381 | A1 | 1/2003 | Riley |
| 2003/0003249 | A1 | 1/2003 | Benim et al. |
| 2003/0011190 | A1 | 1/2003 | Ryan |
| 2004/0068906 | A1 | 4/2004 | Riley |
| 2004/0128892 | A1 | 7/2004 | Valenti |
| 2004/0148836 | A1 * | 8/2004 | Riley ..... 40/633 |
| 2004/0244251 | A1 | 12/2004 | Riley |
| 2005/0091896 | A1 | 5/2005 | Kotik et al. |
| 2005/0108912 | A1 | 5/2005 | Bekker |
| 2005/0279001 | A1 | 12/2005 | Riley |
| 2005/0281989 | A1 | 12/2005 | Finger |
| 2006/0230661 | A1 | 10/2006 | Bekker |
| 2006/0236578 | A1 | 10/2006 | Saint et al. |
| 2006/0242875 | A1 | 11/2006 | Wilson et al. |
| 2006/0261958 | A1 | 11/2006 | Klein |
| 2007/0089342 | A1 | 4/2007 | Jain et al. |
| 2007/0120358 | A1 | 5/2007 | Waggoner et al. |
| 2007/0243361 | A1 | 10/2007 | Riley et al. |
| 2007/0257113 | A1 | 11/2007 | Davis et al. |
| 2008/0098636 | A1 | 5/2008 | Greer |
| 2009/0094872 | A1 | 4/2009 | Ali et al. |
| 2009/0277061 | A1 | 11/2009 | Jain et al. |
| 2009/0282717 | A1 | 11/2009 | Jain et al. |
| 2010/0071241 | A1 | 3/2010 | Jain et al. |
| 2010/0253060 | A1 | 10/2010 | Riley et al. |
| 2010/0281724 | A1 | 11/2010 | Greer et al. |

FOREIGN PATENT DOCUMENTS

| | | |
|---|---|---|
| EP | 1974603 A2 | 10/2008 |
| FR | 2806594 A | 9/2001 |
| GB | 960859 | 6/1964 |
| GB | 2045718 | 11/1980 |
| GB | 2160492 | 12/1985 |
| GB | 2228915 A | 9/1990 |

(56) References Cited

FOREIGN PATENT DOCUMENTS

| | | | |
|---|---|---|---|
| JP | 63175913 | A | 11/1988 |
| JP | 5-61777 | | 8/1993 |
| JP | 08-190350 | | 7/1996 |
| JP | 08299035 | A | 11/1996 |
| JP | 3032299 | | 12/1996 |
| JP | 10-207374 | | 8/1998 |
| JP | 11015383 | A | 1/1999 |
| JP | 2001316921 | A | 11/2001 |
| JP | 2002117190 | A | 4/2002 |
| JP | 2002351321 | A | 12/2002 |
| JP | 2003066849ABSTRA | | 3/2003 |
| JP | 2003157010ABSTRA | | 5/2003 |
| JP | 2003164307ABSTRA | | 6/2003 |
| JP | 2006039209 | | 2/2006 |
| WO | 9502877 | | 1/1995 |
| WO | 9612618 | | 5/1996 |
| WO | 98/23081 | | 5/1998 |
| WO | 99/18817 | | 4/1999 |
| WO | 02/39412 | | 5/2002 |
| WO | 03/003331 | | 1/2003 |
| WO | 2004/028826 | | 4/2004 |
| WO | 2005/064574 | | 7/2005 |
| WO | 2006/007356 | | 1/2006 |
| WO | 2007/021375 | | 2/2007 |
| WO | 2007/133906 | | 11/2007 |
| WO | 2008/079952 | A2 | 7/2008 |
| WO | 2009099787 | A1 | 8/2009 |
| WO | 2009/137195 | | 11/2009 |
| WO | 2010129131 | | 11/2010 |

OTHER PUBLICATIONS

International Search Report for PCT/US2009/031979 dated Mar. 9, 2009.
Office Action for U.S. Appl. No. 11/553,891 dated Mar. 19, 2009.
International Preliminary Report on Patentability (Chapter II) for PCT/US2008/059616 dated Jul. 14, 2009.
International Search Report for PCT/US2009/039183 dated Jun. 25, 2009.
Office Action for U.S. Appl. No. 11/456,928 dated Jun. 15, 2009.
Office Action for U.S. Appl. No. 11/553,872 dated Jun. 17, 2009.
Brochure entitled: "Integrated Document Management Software"; Smead Manufacturing Company; Date Unknown; Form No. SLI-95.
Catalog entitled: "Reseller Catalog Number One"; Smead Software Solutions ; Date Unknown; Form No. SSS-RC1-00.
Sample of Standard Register Labels.
Standard Register, P.S. Magazine, Fall 1998, Dayton, Ohio.
Gretchen Berry, "Wrist Watch," Advance for Healthcare Information Professionals, Feb. 15, 1999.
Sample of Standard Register Label.
"Yes, Sir, That's My Baby!," Material Management in Health Care, Feb. 1999, vol. 8, No. 2, Health Forum, Inc.
Disaster Management Systems, Inc., Triage Tag, Copyright 1996, Pomona, California.
Maryland Department of Transportation, Maryland Emergency Medical Services, Triage Tag, Copyright MIEMMS 1999, Maryland.
Posey Movable I.D. Bracelet; downloaded from http:/www.posey.com/products/4648.html on Aug. 18, 2004.
Avery Dennison DuraCard.
Avery Laminated Identification Cards #5361.
Brochure entitled: "Color-Barâ—Click Stripä Labeling System"; Smead Manufacturing Company; Date Unknown; Form No. SSS-CS-00.
Brochure entitled: "Color-Bar â Folders"; Smead Manufacturing Company; Date Unknown.
Office Action for AU Application No. 2008202215 dated Dec. 15, 2009.
Office Action for EP Application 07842781.2 dated Oct. 25, 2010.
Office Action for U.S. Appl. No. 12/252,710 dated Oct. 15, 2009.
Office Action for U.S. Appl. No. 11/754,812 dated Feb. 9, 2010.
Office Action for CN Application 03825215.5 dated Jan. 8, 2010.
Office Action for EP Application 07842813.3 dated Feb. 4, 2010.
Office Action for U.S. Appl. No. 11/203,601 dated Aug. 17, 2009.
Office Action for U.S. Appl. No. 11/754,812 dated Jul. 24, 2009.
Office Action for U.S. Appl. No. 12/435,541 dated Oct. 29, 2010.
Office Action for U.S. Appl. No. 12/819,709 dated Nov. 8, 2010.
Office Action for U.S. Appl. No. 11/456,928 dated Dec. 8, 2009.
Office Action for U.S. Appl. No. 11/735,078 dated Nov. 17, 2009.
Office Action for U.S. Appl. No. 12/509,151 dated Nov. 13, 2009.
Office Action for AU Application 2006280450 dated Sep. 14, 2009.
Office Action for CN Application 200580019868.5 dated Sep. 4, 2009.
Office Action for EP Application 03773060.3 dated Aug. 11, 2009.
Office Action for U.S. Appl. No. 12/252,710 dated Jun. 10, 2010.
Office Action for U.S. Appl. No. 12/435,541 dated Jul. 7, 2010.
Office Action for U.S. Appl. No. 11/456,928 dated Jun. 8, 2010.
Office Action for U.S. Appl. No. 11/203,601 dated Mar. 30, 2010.
Office Action for U.S. Appl. No. 11/455,131 dated Mar. 9, 2010.
Office Action for U.S. Appl. No. 11/553,891 dated Mar. 8, 2010.
Office Action for U.S. Appl. No. 12/819,709 dated Aug. 19, 2010.
Office Action for U.S. Appl. No. 11/455,131 dated Aug. 31, 2010.
Office Action for U.S. Appl. No. 12/627,227 dated Aug. 31, 2010.
Office Action for U.S. Appl. No. 11/373,923 dated Jan. 21, 2010.
Office Action for U.S. Appl. No. 11/405,149 dated Dec. 28, 2009.
Office Action for U.S. Appl. No. 11/763,615 dated Jan. 22, 2010.
Office Action for U.S. Appl. No. 11/373,923 dated Jun. 1, 2009.
Office Action for U.S. Appl. No. 11/374,273 dated May 26, 2009.
Office Action for U.S. Appl. No. 11/562,114 dated May 6, 2009.
Office Action for U.S. Appl. No. 11/735,078 dated May 28, 2009.
Office Action for U.S. Appl. No. 11/763,615 dated May 6, 2009.
Office Action for AU Application 2006280450 dated Aug. 31, 2010.
Office Action for AU Application 2007317692 dated Aug. 12, 2010.
Office Action for CN Application 03825215.5 dated Aug. 30, 2010.
Office Action for EP Application 03773060.3 dated Aug. 30, 2010.
Office Action for JP Application 2005-501996 dated Jul. 6, 2010.
Office Action for JP Application 2007-516565 dated Jul. 13, 2010.
International Preliminary Report on Patentability (Chapter I) for PCT/US2008/064972 dated Dec. 1, 2009.
International Search Report and Written Opinion for PCT/US2010/030361 dated Jul. 16, 2010.
International Preliminary Report on Patentability (Chapter II) for PCT/US2009/031979 issued May 21, 2010.
International Preliminary Report on Patentability (Chapter II) for PCT/US2009/039183 issued Apr. 20, 2010.
Office Action for AU Application 2007238028 dated Apr. 19, 2010.
Office Action for JP Application No. 2006-547497 dated Mar. 23, 2010.
Office Action for NZ Application 566071 dated May 7, 2010.
Final Office Action for U.S. Appl. No. 11/735,078 dated Jul. 23, 2010.
Office Action for U.S. Appl. No. 11/373,923 dated Jul. 13, 2010.
Office Action for U.S. Appl. No. 12/115,945 dated Aug. 9, 2010.
Office Action for U.S. Appl. No. 12/252,654 dated Aug. 12, 2010.

* cited by examiner

CONTINUOUS STRIP OF THERMAL WRISTBAND/LABEL FORMS

BACKGROUND AND SUMMARY OF THE INVENTION

Combination wristband/label forms have become well known in the business form and medical arts, and commercialized to great success, through the innovative efforts of the inventor herein as well as others through the company which is the assignee hereof. Examples of the inventive wristband/label forms which have met with significant commercial success may be found in just a few representative US patents which have already been issued, and for which multiple patent applications remain in prosecution. See, for example, issued U.S. Pat. Nos. 7,017,293; 7,017,294; 7,047,682; 7,222,448; and 7,325,347.

While many of these wristband/label designs are intended for printer processing through a laser printer, with its generally universal capability to process forms of widely varying dimensions, a couple of these inventive designs have been particularly identified for printing by thermal printers. Some of these inventive designs have also been adapted for use with thermal printers, with their more limited capability to process forms of varying sizes. One such example is shown in FIG. 1 which depicts a fan fold, continuous strip 100 of a plurality of wristband/label assemblies or forms 102, separated by a line of weakness 104 to facilitate each assembly from the strip 100 after being printed. The wristband 106 is itself a self-laminating design, with a center image-receiving area 108 die cut into a top face ply and a laminating portion 110 having a pair of offset straps 112 die cut into a backing layer of laminate. After being printed with the patient's identification information, and then separation of the wristband 106 from the assembly 102, the laminating portion 110 is folded over the image receiving portion 108 and the self laminating wristband 106 is secured to the wearer's wrist with a patch of adhesive 114 on the ends of one or both of the straps 112. A wristband extender 116 is also formed in the wristband portion and may be used to extend either strap 112 to accommodate patient's with bigger wrists. A bottom portion of the assembly has a plurality of self adhering labels 118 die cut into a label portion 120, for separate removal and use.

While this combination wristband/label design, as adapted for use with a thermal printer, has met with great commercial success, it's approximately four inch width has limited its usability to only those thermal printers having a "throat" large enough to accept it. It has become widely accepted in the industry that combination wristband/label forms are best suited to medical applications as admitting a new patient virtually always creates a need not only for a wristband for the patient, but also labels for charts, specimen bottles, utensils, etc. The combo form contains both the wristband and labels which may be printed up at the same time by a single printer to minimize any chance for error, and presented to the admitting personnel for patient in-processing. Thus, there is a long felt need for a combination form, or "combo" as it's called, in the thermal printer medical market. While many of the newer thermal printer designs are capable of accepting and printing a form as large as the aforementioned design, there is a substantial installed base of older thermal printers which have a two inch throat and which are thus unable to accept and use this combination wristband/label form. In addition, as hospitals have been moving to bedside banding of patients utilizing mobile computers and printers on wheeled carts, there is a significant growth market for light, small-throat thermal printers that can be easily mounted on such carts and moved between patient rooms. Thus, while the inventors previous design has partially met this long, unsolved need, and has been received with great commercial success, it has not completely met the needs of the owners of smaller thermal printers.

Yet another factor to be considered with regard to the existing installed base is the matter of wristband expense. For many users, their older thermal printer continues to work just fine and they are reluctant to spend the money to upgrade to a newer thermal printer, much less a laser printer. As cost is an issue for these users, there would be resistance to adopting the form described and shown in FIG. 1 even if it could be made in a two inch format for the reason that its construction is more complex than a simple non-laminating wristband and, hence, more expensive. Although the greater reliability, reduced need to replace wristbands, and other factors if fully considered would prove that the cost of the more complex form is more than justified, many users just can't get past the initial cost and use that factor exclusively to determine which wristband to buy.

The foregoing has created a long felt need for a wristband/label "combo" assembly/form which is capable of being processed through the significant installed based of thermal printers having a two inch throat. This need extends beyond the need of the installed base as newer installations with the smaller thermal printers represent a new application which is increasing this need. Yet another aspect to this need is a combo form that is low cost, with relatively simple design wristbands and labels. Still another aspect of the need, which contributes to the cost, is to eliminate "wastage" or left over and unused materials upon use of the combo form. As the amount of material used in each wristband or label directly contributes to the cost, eliminating wastage can significantly lower the cost of the form.

As an additional solution to the unsolved needs of the owners of thermal printers, as at least partially described above, the inventor herein has succeeded in designing and developing a two inch wide combo form, with the wristband design being non-laminating but also of relatively simple construction so as to reduce cost, and with a label area of alternative embodiments one of which includes providing weakness points allowing a user to tear off labels of varying length and shape to suit the need. The wristband is preferably constructed to occupy the entirety of the wristband area of the combo form, with one end having a peel away tab for exposing adhesive to be used to secure the wristband about the wearer's wrist, to thereby eliminate wastage. The label area has been conceived in alternate embodiments. One embodiment comprises a two ply area with die cuts defining individually separable, self adhering labels; a second embodiment comprises a two ply construction with die cuts defining individually separable, self adhering labels with the labels occupying the entirety of the top ply to minimize wastage, and a third embodiment comprising a two ply construction with a die cut defining a label area with pairs of Vee shaped "nicks" spaced along the upper and lower border thereof to allow a user to conveniently tear the label area at a desired location to shape and size labels as needed. While preferably a plurality of these forms would be provided in a fan fold strip, they may also be provided either as a roll or even as individual forms.

While the principal advantages and features of the present invention have been briefly described above, a fuller understanding of the preferred embodiment of the invention may be attained by referring to the drawings and detailed description that follows.

DETAILED DESCRIPTION OF THE PREFERRED EMBODIMENT

The four inch, combo thermal form with self laminating wristband has been described above, and is a good and valuable invention subject to patent protection with several patents issued and others pending, all of which have been assigned to the assignee hereof. This form has been met with great commercial success and represents a significant improvement over the prior art.

Figure 1:
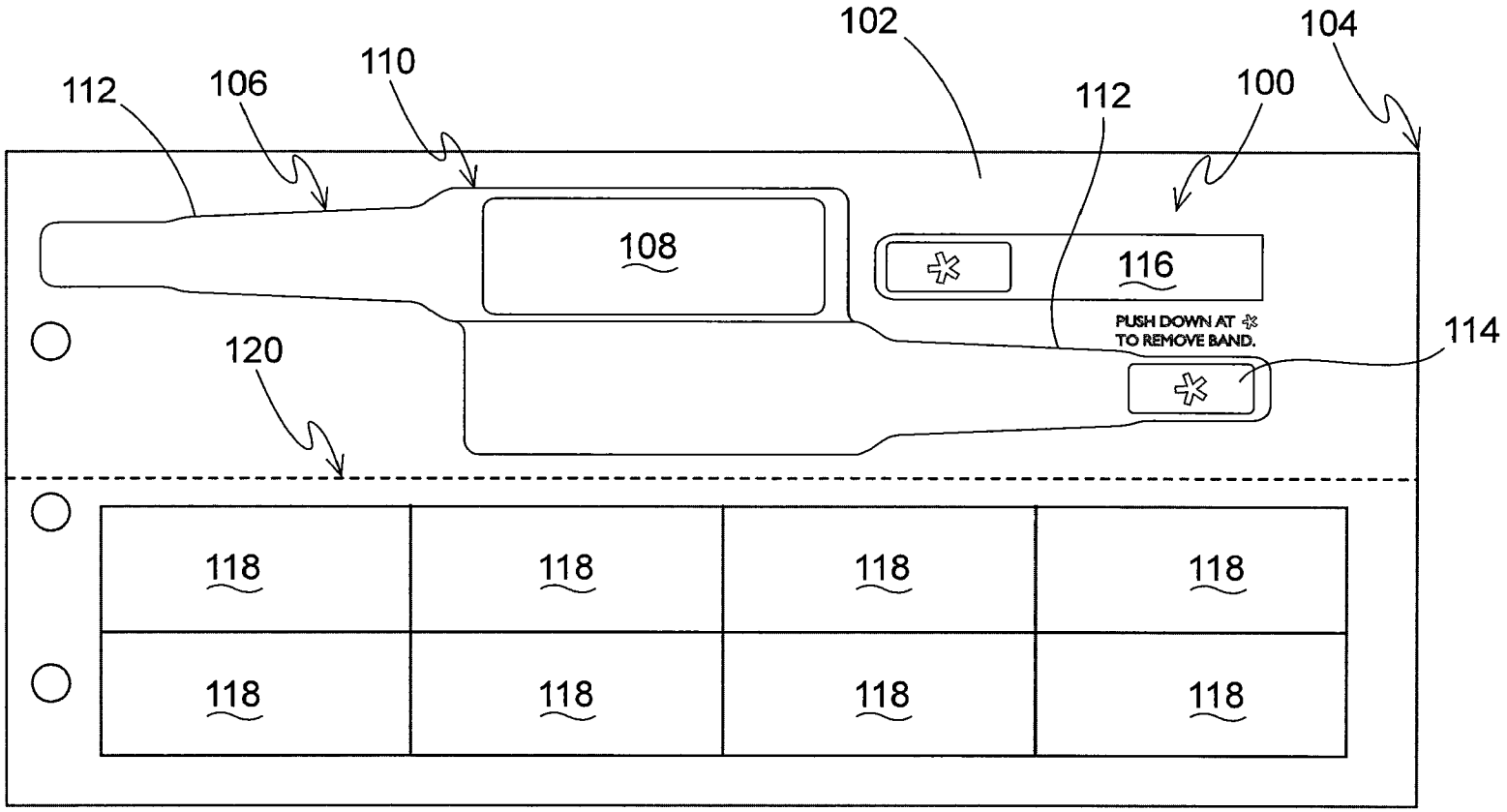
FIG. 1 is a plan view depicting a four inch wide thermal combo form taken from a fan fold strip of a plurality thereof, with a top portion having a self laminating wristband and extender defined by die cuts and a bottom portion having die cuts defining individually separable, self adhering labels, all in two ply construction comprising a face top ply and a laminate bottom ply.
Figure 2:
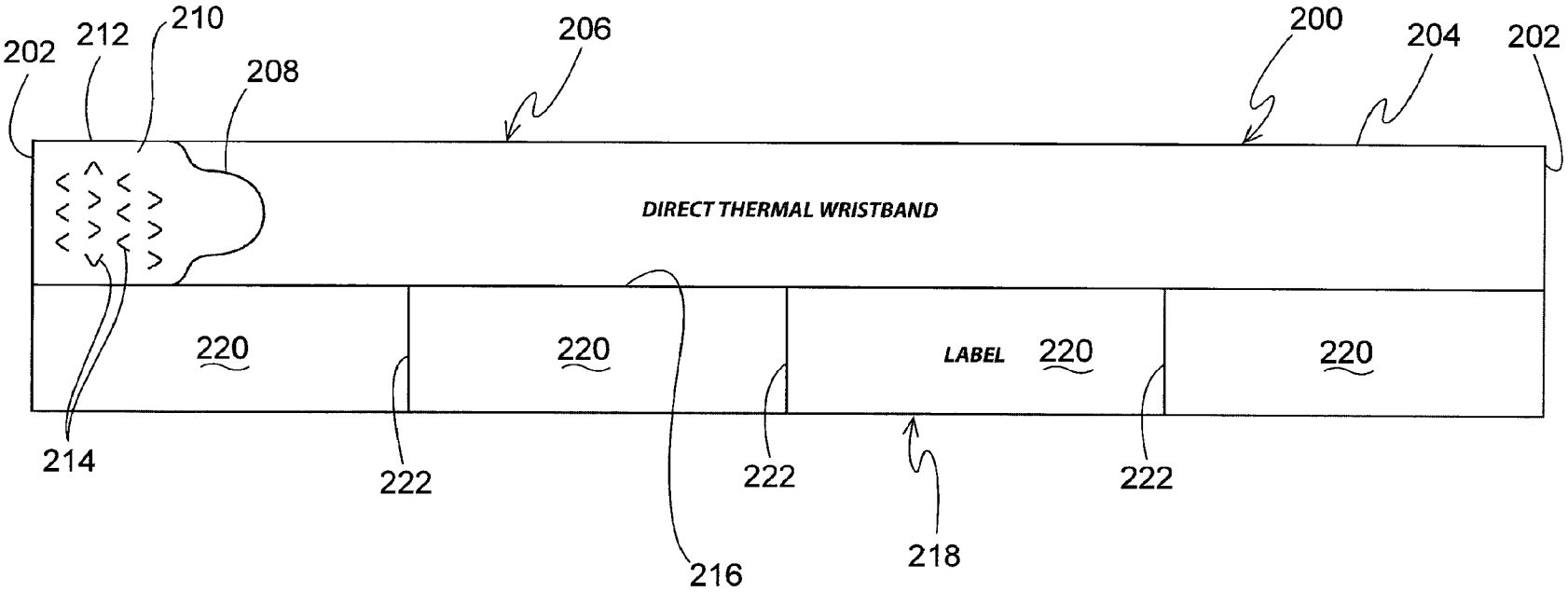
FIG. 2 is a plan view depicting a two inch wide, two ply, thermal combo form taken from a fan fold strip of a plurality thereof, with the top area comprising a wristband with a peel away end tab to expose adhesive for securing it about a wearer's wrist, and a bottom label area having a plurality of self adhering labels defined by die cuts.

The present invention is exemplified by the preferred embodiments shown in the next several figures. FIG. 2 depicts a single two inch combo thermal form/assembly 200, but it is to be understood that preferably these form/assemblies are provided joined end to end at their narrower end, in a fan fold strip for ready feeding into the throat of a thermal printer. For clarity, a single form is shown but multiple forms would typically be joined with a line of weakness 202 separating adjacent forms. The line of weakness 202 could be a line of perforation, a die cut or other similar type of construction as would allow for the ready separation of adjacent forms after being processed by a thermal printer but which would be strong enough to retain the forms together in a fan fold strip before, during and after printing. As used herein, the term die cut, perforation, line of weakness is meant to include any of the other terms as would be deemed appropriate by one of ordinary skill in the art.

As mentioned, the combo thermal form depicted in FIG. 2 includes a wristband 204 preferably of two or three ply construction with one of said plies 206 being suitable to receive and retain an imprint by a thermal printer printing in a conventional fashion. Examples of materials from which each ply may be constructed include polypropylene for the thermal imaging ply and polyester for the backing ply. As is known in the art, a thermal print ply may be coated with a protective coating, such as a lacquer coating, to protect the print surface from being "spoiled" by extraneous environmental assaults such as from liquids, fluids, UV, etc. Yet another technique for protecting the thermally printed surface is to provide a ply of polyester or polypropylene, such as for example in a ½ mil. or even thinner size to the same reasons. As a protective coating or ply may or may not be applied, as a matter of choice, for purposes of this disclosure it will be considered as an option which is not central to the invention. One of the two plies has a die cut 208 at an end of the wristband defining a peel away tab 210 for exposing a layer of adhesive 212 for securing the wristband 204 to a wearer's wrist. Another series of die cuts 214 in the ply underlying the tab 210 create a series of pull away portions thereof so that after being secured and adhered to the other end, these pull away portions would separate should the adhesive seal be broken. This provides a security seal to indicate when the wristband has been removed from the wearer and re-attached and helps discourage wristband wearers from swapping wristbands, for example, and thereby ensure that once banded, the wearer is wearing his correct wristband.

As shown in FIG. 2, the wristband 204 comprises the entirety of the top area of the form 200. This eliminates wastage and helps reduce cost. Also, its design allows it to make full use of the allotted one inch width, thereby maximizing the space allotted for printing of patient information, etc. In the preferred embodiment the wristband 204 occupies one half the width of the form, or a nominal one inch, while the other area as described below occupies another nominal one inch of width. However, this is to some extent a matter of design choice and the invention shall not be considered as limited in any manner thereby.

A die cut 216 running longitudinally along the length of the form 200 separates the top area or wristband 204 from the bottom or label area 218. In FIG. 2, the label area 218 has a plurality of self adhering labels 220 formed by a plurality of die cuts 222. The labels 220 occupy the entirety of the label area 218, thereby eliminating wastage. Alternately, a series of die cuts (not shown), could be used to define a series of separated labels of any design of choice, limited solely by the overall dimensions of the label area 218, as would be apparent to one of ordinary skill. As mentioned above, the term die cut should be understood as encompassing other similar lines of weakness as is typically used in forms of these kind, such as perforations, etc.

Figure 3:
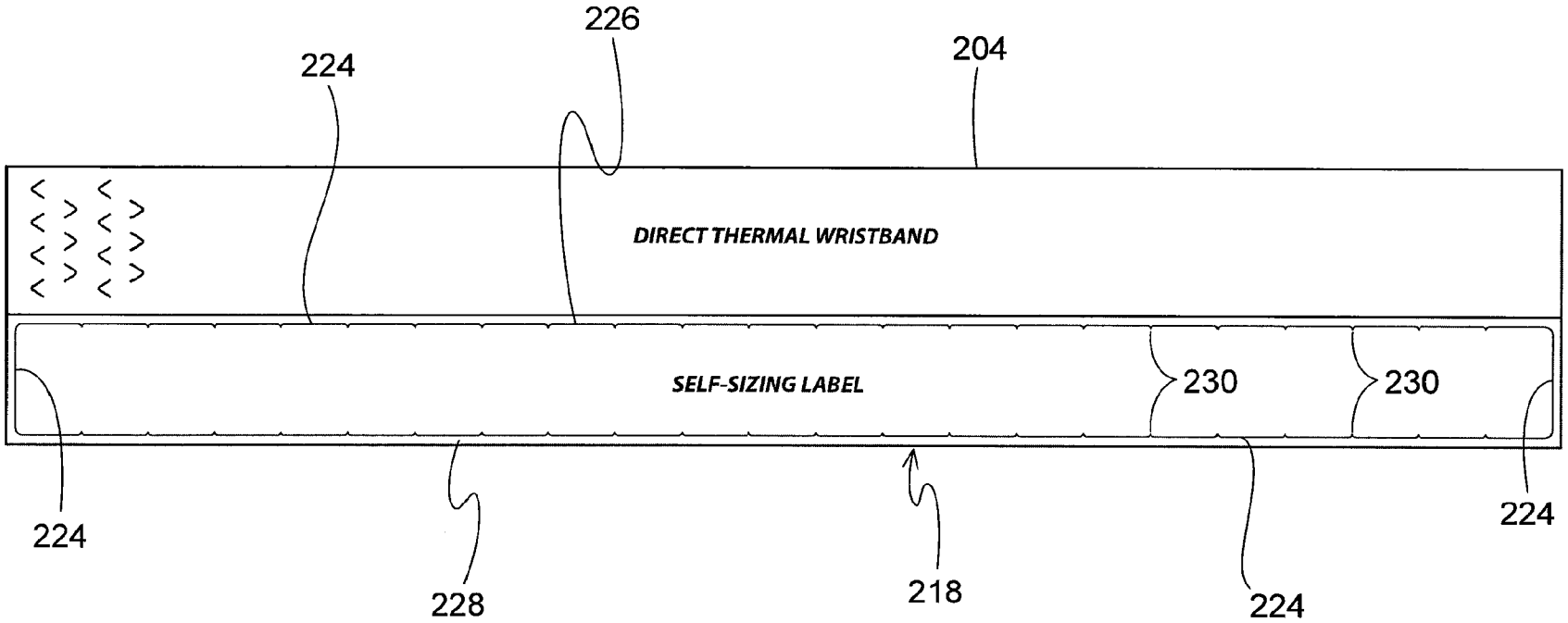
FIG. 3 is a plan view depicting a two inch wide, two ply, thermal combo form taken from a fan fold strip of a plurality thereof, with the top area comprising a wristband with a peel away end tab to expose adhesive for securing it about a wearer's wrist, and a bottom label area defined by a die cut with a plurality of pairs of nicks spaced along the upper and lower border thereof for tearing off labels of differing length.

As shown in FIG. 3, the same wristband 204 occupies the entirety of the top area of the form 200, but a different embodiment is shown for the label area 218. A die cut 224 extends around the periphery of the label area 218, with an upper border 226 and a lower border 228 having a series of pairs of nicks 230 spaced therealong. Upon separation of the wristband 204, the label area may be conveniently torn from one nick 230 in the upper border 226 to another nick 230 in the bottom border 228 to thereby size a label of any desired length, multiple labels of differing length, etc. In fact, although somewhat less convenient, the user may tear from one nick to another nick offset from the first nick to thereby create a label having an oblique end. Furthermore, pairs of nicks in any desired arrangement could be provided to allow for pre-designated label length or design. While nicks have been depicted as generally being of a rounded "Vee" shape, other shapes could conveniently be used with the desire being to create points of weakness along the upper and lower borders.

While in its preferred embodiment the combo thermal form invention is described as having a nominal two inch width or height, in a broader sense the invention should not be considered as so limited in view of its other novel and patentable features.

While the principal advantages and features of the present invention have been described herein in the form of preferred embodiments, one of ordinary skill in the art could readily determine variations or modifications to the invention relying on the teaching of this disclosure and those variations and features should be considered as part of the present invention. For example, while the preferred embodiment is disclosed as preferably having a width of a nominal two inches divided substantially equally between the wristband and labels, that is not intended to be an exact or limiting dimension except as it shall be recited in the claims, it only being intended to be sufficiently sized overall to be processed by a thermal printer. The materials disclosed are preferred but other materials could be used as well. Protective coatings or plies could be added to the form without departing from the spirit of the concept. Accordingly, the invention is intended to be limited solely by the scope of the claims appended hereto and their legal equivalents.

What is claimed is:

1. A strip of a plurality of thermal printer processible wristband/label assemblies, said wristband/label assemblies being joined at their ends to adjacent wristband/label assemblies to form the strip with a line of weakness separating adjacent assemblies, each of said wristband/label assemblies comprising:

two areas, a wristband area comprising a full length wristband with its longest dimension extending between said adjoining wristband/label assemblies and comprising substantially the entirety of the wristband area, and a label area comprising a plurality of labels extending substantially the full length of the wristband/label assembly, wherein at least some of the label areas have weakness points to facilitate the separation of one or more labels from said label area, wherein at least some of said weakness points comprise a pair of substantially aligned nicks positioned along the upper and lower border of its associated label area to facilitate tearing of the label area between a pair of nicks to thereby variably size a label, and a line of weakness extending between said adjoining wristband/label assembly ends and separating said wristband area from said label area to facilitate their ready separation from each other, each of said wristband/label assemblies being substantially rectangular shaped and oriented to be fed into said thermal printer from its shortest dimension to thereby maximize the size of each wristband/label assembly processible in a continuous manner by said thermal printer.

2. The strip of claim 1 wherein at least some of said weakness points comprise a plurality of die cuts extending from an upper border to a lower border of the label area.

3. The strip of claim 1 wherein at least some of said weakness points comprise die cuts defining a plurality of individually formed labels for individual separation from its associated assembly.

4. The strip of claim 1 wherein at least some of said pairs of nicks are irregularly spaced along the label area to facilitate the formation of variable length labels.

5. The strip of claim 1 wherein the wristband comprises substantially the entirety of the wristband area and the plurality of labels comprises substantially the entirety of the label area, thereby minimizing wastage.

6. The strip of claim 1 wherein at least some of said wristband/label assemblies are comprised of only two plies with each of said plies being made of either polypropylene or polyester.

7. The strip of claim 1 wherein each of said wristband area and said label area are constructed of materials suitable for thermal printing, and wherein the width of each of said assemblies are sized to substantially fill a typical opening for a thermal printer.

8. The strip of claim 7 wherein the width of said strip is nominally two inches.

9. The strip of claim 8 wherein each of the wristband and the label area occupies approximately one inch of the overall strip width.

10. The strip of claim 1 wherein the wristband area of at least some of said assemblies extends the full length of the assembly and includes an adhesive coated end for securing the wristband about a wearer's wrist.

11. The strip of claim 1 wherein at least some of the forms are comprised of two plies, each of said plies being made of a film material.

12. A fan fold, continuous strip of a plurality of thermal printer processible wristband/label business forms, said wristband/label forms being generally rectangularly shaped and being joined at their narrower ends to adjacent wristband/label forms to form the strip with a die cut separating adjacent forms, each of said wristband/label forms comprising:

two longitudinal areas, a wristband area comprising a full length wristband extending substantially the full length of the form and occupying substantially the entirety of the wristband area, wherein the wristband comprises the entirety of the wristband area, a label area comprising a label portion extending substantially the full length of the form, wherein the label portion has a plurality of pairs of nicks spaced along an upper and lower border thereof to facilitate tearing of said label portion there between to create labels of a variable size, each of said areas having substantially the same width of a nominal one inch, and a die cut separating said areas to facilitate their ready separation from each other and the form.

13. The strip of claim 12 wherein said nicks are substantially evenly spaced along the borders and aligned with each other.

14. The strip of claim 12 wherein the label portion comprises the entirety of the label area, so that labels occupy the entirety of the label area.

15. The strip of claim 12 wherein each of said business forms is comprised of two plies, each of said plies being made of a film material.

16. The strip of claim 15 wherein at least one of said plies is adapted to receive a thermal image, and further comprising a protective layer covering said at least one ply.

17. The strip of claim 16 wherein said protective layer comprises a coating.

18. The strip of claim 16 wherein said protective layer comprises a ply of either polyester or polypropylene.

* * * * *